US009481971B2

(12) United States Patent
Maglio et al.

(10) Patent No.: US 9,481,971 B2
(45) Date of Patent: Nov. 1, 2016

(54) INCREMENTALLY ADJUSTABLE FLUID CONTROL SYSTEM AND METHODS OF INSTALLING AND ADJUSTING SAME

(71) Applicants: Coraggio K. Maglio, Vicksburg, MS (US); Brandan M. Scully, Charleston, SC (US); Nathan D. Lovelace, Mobile, AL (US)

(72) Inventors: Coraggio K. Maglio, Vicksburg, MS (US); Brandan M. Scully, Charleston, SC (US); Nathan D. Lovelace, Mobile, AL (US)

(73) Assignee: The United States of America as Represented by The Secretary of The Army, Washington, DC (US)

( * ) Notice: Subject to any disclaimer, the term of this patent is extended or adjusted under 35 U.S.C. 154(b) by 0 days.

(21) Appl. No.: 14/677,547

(22) Filed: Apr. 2, 2015

(65) Prior Publication Data

US 2015/0284923 A1 Oct. 8, 2015

Related U.S. Application Data

(60) Provisional application No. 61/975,421, filed on Apr. 4, 2014.

(51) Int. Cl.

| | |
|---|---|
| ***E02B 7/36*** | (2006.01) |
| ***E02B 7/28*** | (2006.01) |
| ***E02B 8/04*** | (2006.01) |

(52) U.S. Cl.

CPC . *E02B 7/28* (2013.01); *E02B 7/36* (2013.01); *E02B 8/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,221,416 | A * | 9/1980 | Piontkowski | B66F 15/00 254/94 |
| 7,552,565 | B1 * | 6/2009 | Smith | E06B 9/02 29/281.1 |
| 2003/0026660 | A1 * | 2/2003 | Wu | E02B 7/205 405/87 |
| 2009/0252557 | A1 * | 10/2009 | Fisher | E06B 9/02 405/107 |
| 2011/0259429 | A1 * | 10/2011 | Whipps | E02B 7/36 137/1 |
| 2013/0108370 | A1 * | 5/2013 | Hanna | E02B 7/40 405/99 |

FOREIGN PATENT DOCUMENTS

DE 000954586 C * 12/1956

* cited by examiner

*Primary Examiner* — Benjamin Fiorello
*Assistant Examiner* — Kyle Armstrong
(74) *Attorney, Agent, or Firm* — Brian C. Jones

(57) ABSTRACT

The present invention provides a water control system with the reservoir level versatility of a weir stack and the relatively easy drainage of a water control gate. Multiple stack beams constrained between two opposed guide channels create a fluid reservoir having an incrementally adjustable fluid level. Increasing or decreasing the reservoir level is a matter of adding or removing one or more stack beams. To create an opening for draining fluid from any level of the reservoir, a picker mechanism captures at least one of the stack beams. By lifting the captured stack beam, and any stack beams atop the captured stack beam, the picker mechanism opens a gate at any level of the reservoir through which fluid may flow.

18 Claims, 4 Drawing Sheets

INCREMENTALLY ADJUSTABLE FLUID CONTROL SYSTEM AND METHODS OF INSTALLING AND ADJUSTING SAME

CROSS-REFERENCE TO RELATED APPLICATIONS

This patent application claims the benefit of U.S. Provisional Application No. 61/975,421 filed Apr. 4, 2014. The above application is incorporated by reference herein in its entirety.

STATEMENT REGARDING FEDERALLY SPONSORED RESEARCH OR DEVELOPMENT

The invention described herein was made by an employee of the United States Government and may be manufactured and used by the Government of the United States of America for governmental purposes without the payment of any royalties thereon or therefore.

BACKGROUND OF THE INVENTION

1. Field of Invention

This invention relates to the field of hydraulic engineering and more specifically to a vertically sliding adjustable fluid control system.

2. Description of Related Art

Weir stacks and water control gates are permanent structures known in the art used to maintain desired water levels and to control the stage, discharge, distribution, delivery or direction of water flow.

A weir stack is a barrier that operates like a small adjustable dam, pooling water behind the stack while also maintaining a maximum water level by allowing it to flow steadily over the top of the stack. Common uses of weir stacks include altering the discharge flow of rivers to prevent downstream flooding, regulating fluid discharge and rendering rivers navigable. Typically, weir stacks consist of a stack of "stop logs" fabricated out of timber or aluminum and held into place with vertical channels. One of problems known in the art is that buoyant stop logs can float, compromising the stack. Additionally, water level control is typically achieved by removing logs from or adding logs to the stack. Adjusting the weir stack places personnel at risk in situations where the flow of water is powerful.

Water control gates are used as an alternative to weir stacks. A control gate is a single, solid structure held into place with vertical channels, or hinged and employing water pressure to seat the gate. Water is drained from a reservoir by lifting a mechanically actuated gate. Constructing a water control gate is an expensive undertaking, because the structure requires a substantial foundation and complex engineering. Once installed, it is difficult to modify the structure as environmental conditions change. Another problem known in the art is that water released from the reservoir bottom may contain undesired sediment or be under unacceptably high pressure.

Traditional water control structures in the art offer limited options for adjusting and controlling the flow of water, are difficult to modify and are not capable of achieving incremental release or multiple flow paths.

BRIEF SUMMARY OF THE INVENTION

In one embodiment, an incrementally adjustable fluid control system includes two guide channels, a plurality of stack beams and a picker mechanism. The two guide channels are located in opposition. Each guide channel includes a plurality of guide channel flanges connected by a guide channel web. The plurality of stack beams are constrained between the two guide channels. Each stack beam includes a stack beam channel and a plurality of stack beam flanges operatively connected by a stack beam web. Each stack beam is made of a non-porous, non-buoyant material. The picker mechanism includes a picker beam operatively connected to a picker rod by a picker connector.

In another embodiment, a method for opening an incrementally adjustable fluid control system includes the step of determining a desired gate opening height within a plurality of stack beams constrained between two guide channels. Each guide channel includes a plurality of guide channel flanges connected by a guide channel web. Each stack beam includes a stack beam channel and a plurality of stack beam flanges operatively connected by a stack beam web. Each stack beam is made of a non-porous, non-buoyant material. Next, the method lowers a picker mechanism including a picker beam operatively connected to a picker rod by a picker connector, until the picker beam reaches a stack beam corresponding to the desired gate opening height. The method then inserts at least one of the picker beam flanges between at least two of the plurality of stack beam flanges and applies a lifting force to the picker beam through the picker rod. Next, the method raises at least one of the plurality of stack beams along the two guide channels.

In another embodiment, a method for installing an incrementally adjustable fluid control system includes the step of fixing two guide channels in opposition. Each guide channel includes a plurality of guide channel flanges connected by a guide channel web. The method then inserts a plurality of stack beams into the guide channels such that the plurality of stack beams are constrained between the two guide channels and substantially block movement of a fluid through an area located between the guide channels. Each stack beam includes a stack beam channel and a plurality of stack beam flanges operatively connected by a stack beam web. Each stack beam is made of a non-porous, non-buoyant material. Next, the method supplies a picker mechanism including a picker beam operatively connected to a picker rod by a picker connector.

BRIEF DESCRIPTION OF SEVERAL VIEWS OF THE DRAWING(S)

FIGS. 1*a*-1*c* are top, back and side views, respectively, illustrating an exemplary embodiment of an incrementally adjustable fluid control system.

TERMS OF ART

As used herein, the term "horizontal tolerance" means a physical, horizontal distance between two parts.

As used herein, the term "non-buoyant material" means a material having an average density greater than that of a fluid in which the material is immersed.

As used herein, the term "non-porous material" means a material that does not gain more than 5% weight when immersed in fluid for a period of time of at least one week.

DETAILED DESCRIPTION OF THE INVENTION

Figure 1A:
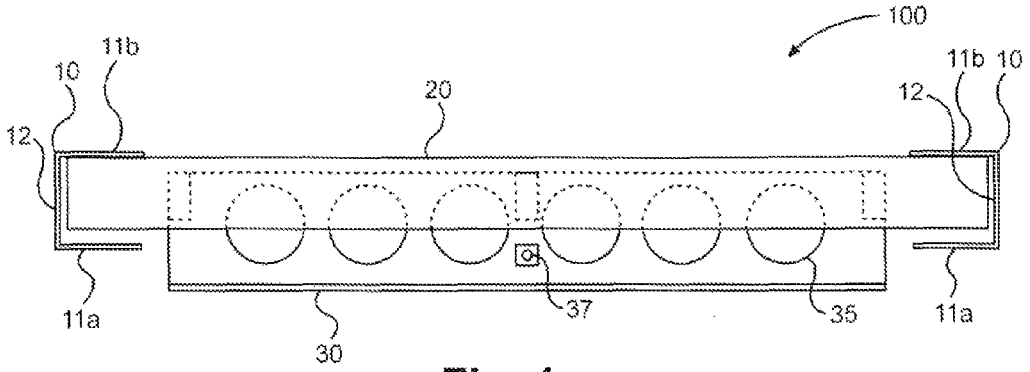
Figure 1B:
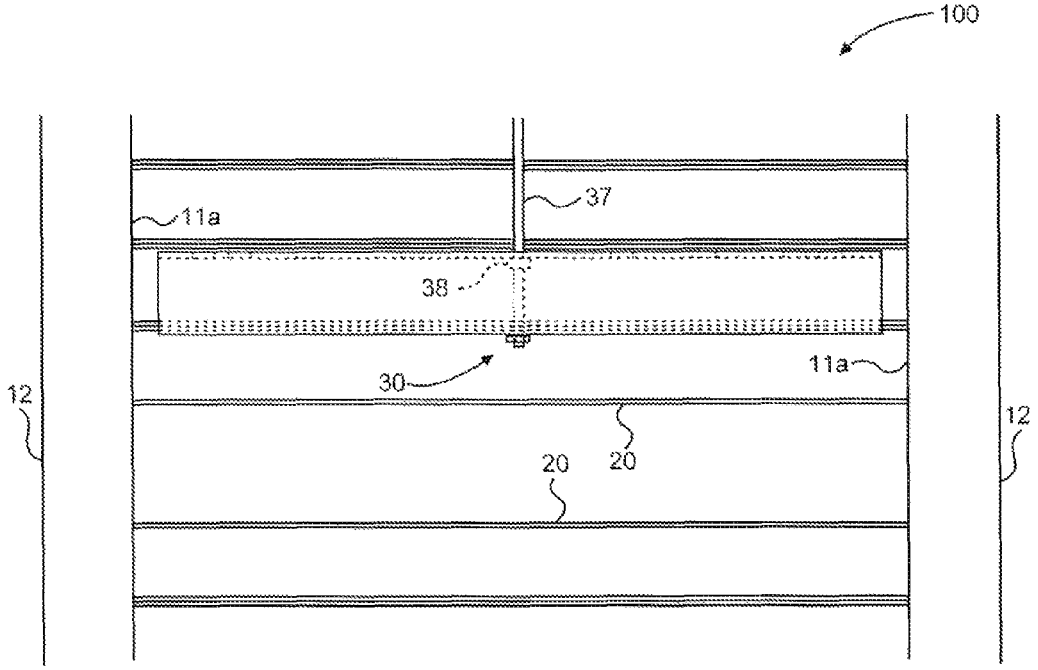
Figure 1C:
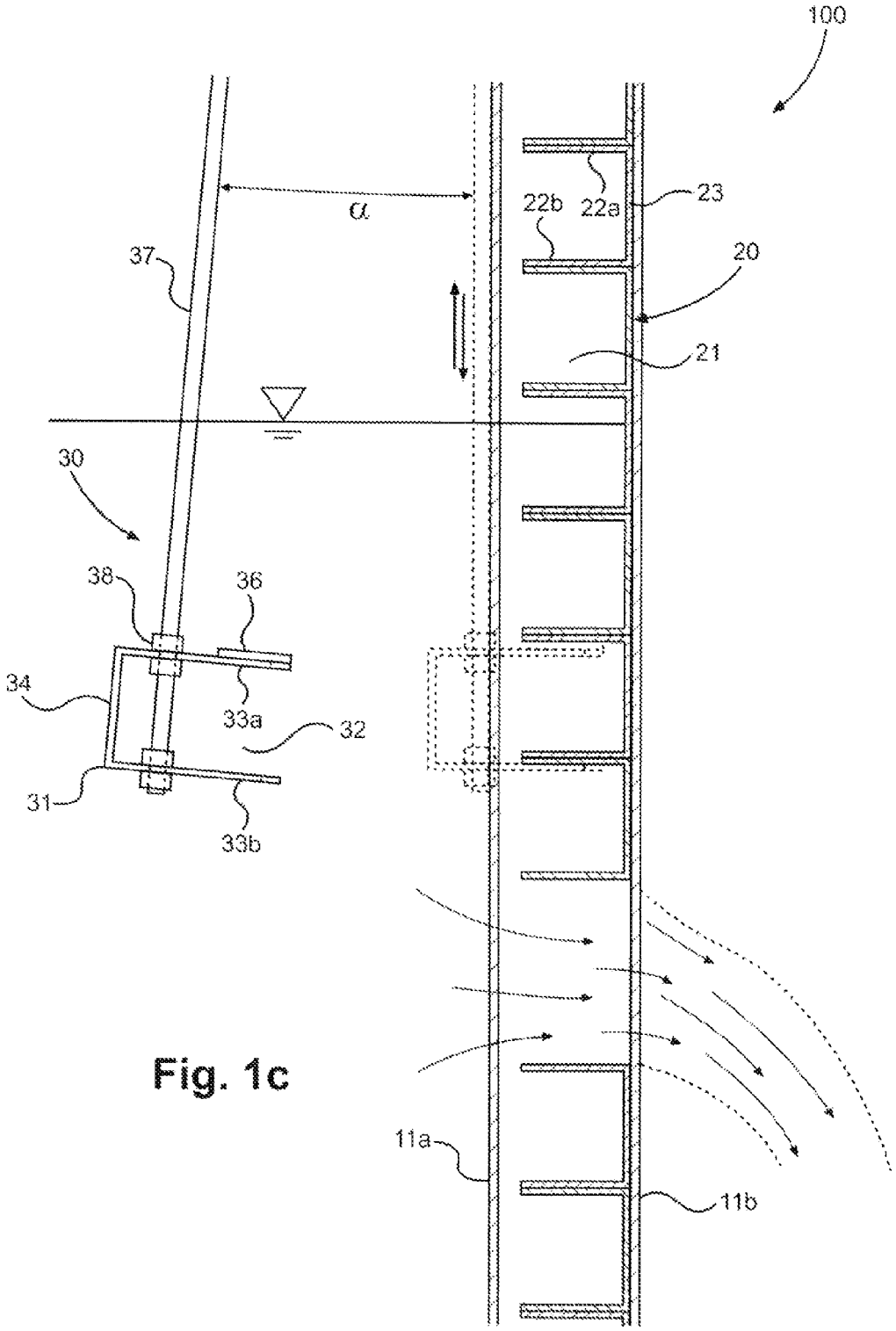

FIGS. 1*a*-1*c* are top, back and side views, respectively, illustrating an exemplary embodiment of an incrementally adjustable fluid control system 100. Incrementally adjustable fluid control system 100 includes two guide channels 10, a plurality of stack beams 20 and a picker mechanism 30.

Guide channels 10 are substantially vertically oriented channels located opposite each other. Each guide channel 10 includes two guide channel flanges 11*a* and 11*b* connected by a guide channel web 12. In the exemplary embodiment, guide channels 10 are spaced apart according to the width of the fluid channel bracketed. In other embodiments, multiple guide channels 10 may be attached along their respective guide channel webs 12 to connect multiple incrementally adjustable fluid control systems 100. In still other embodiments, guide channels 10 may be attached along their respective guide channel webs 12 to posts or other structures within a fluid channel or reservoir to enable fluid guidance. Guide channels 10 may be attached along their respective guide channel webs 12 using means including, but not limited to, an adhesive, at least one mechanical fastener or a combination thereof.

Guide channels 10 partially enclose first and second ends of the plurality of stack beams 20. Guide channel flanges 11*a* and 11*b* have a width greater than twice the horizontal tolerance of stack beams 20. This width ensures guide channel flanges 11*a* and 11*b* are wide enough to securely hold stack beams 20, while not so wide as to impede fluid flow. Guide channel flange 11*b* provides a smooth mating surface with stack beams 20. A length of guide channel web 12 is approximately 5% to approximately 15% longer than a length of stack beams 20. This tolerance allows for substantially frictionless raising of stack beams 20 but is not enough to allow stack beams 20 to become slanted and/or wedged The plurality of stack beams 20 are vertically stacked atop each other between guide channels 10 to lie in a substantially horizontal orientation. Stack beam flanges 22*a* and 22*b* and stack beam web 23 surround stack beam channel 21. In the exemplary embodiment, each of the plurality of stack beams 20 has a C-shape formed by connecting stack beam flanges 22*a* and 22*b* with stack beam web 23. In the exemplary embodiment, stack beam channel 21 faces upstream while stack beam web 23 faces downstream. In an alternate embodiment, stack beam channel 21 faces downstream while stack beam web 23 faces upstream. In this embodiment, the ends of stack beams 20 are sealed.

In the exemplary embodiment, the plurality of stack beams 20 with stack beam channels 21 facing upstream provides a large flat sealing surface between beam web 23 and guide channel flange 11*b*, forming a wall spanning the horizontal distance between guide channel flanges 11*a* and 11*b*. Another embodiment of stack beam 20 closes stack beam channel 21 with an additional stack beam web 23 to create a hollow core stack beam 20. In another embodiment, the plurality of stack beams 20 is a combination of C-shaped stack beams 20 and hollow core stack beams 20. In one embodiment, certain individual stack beams 20 may be attached to other stack beams 20 to limit potential openings. Stacks beams 20 may attach to each other through adhesive or welding, or may be integrally formed.

Each of the plurality of stack beams 20 is a non-porous, non-buoyant material. This material may be, but is not limited to, composite material, stainless steel and marine grade aluminum. In one embodiment, the stack beams are fiberglass reinforced, UV resistant polymer resin. Calculation of the density and resultant buoyancy of the material takes into account the specific gravity of the surrounding fluid and any air pockets contained within stack beam 20 in embodiments using hollow core stack beams 20.

In the exemplary embodiment, the easily accessible stack beam flanges 22*a* and 22*b* allow for insertion of a lifting mechanism such as, but not limited to, picker mechanism 30 into stack beam channel 21 to lift the plurality of stack beams 20. In another embodiment, part of picker mechanism 30 inserts between two stack beams 20. Because lifting the plurality of stack beams 20 can occur at any point along the plurality of stack beams 20, system 100 may create a window anywhere in the plurality of stack beams 20 and function interchangeably as a sluice, a weir or a suspended orifice. This can allow for the bypassing of sediment to maintain reservoir capacity or controlled drainage of a reservoir to a given level.

Picker mechanism 30 includes picker beam 31, picker rod 37 and picker connector 38. Picker beam 31 has a width of approximately 50% to less than 100% of the width of stack beam 20. This width prevents stack beam 20 from rising in a non-level manner when raising the plurality of stack beams 20 if uneven weighting occurs in stack beam channel 21 due to settled sediment or unequal fluid or slurry drainage. This also reduces the likelihood of stack beam 20 tilting and becoming wedged in guide channel 10.

In the exemplary embodiment, picker beam 31 includes picker beam channel 32, picker beam flanges 33*a* and 33*b*, picker beam web 34, optional picker beam apertures 35 and optional picker beam spacer pads 36. In the exemplary embodiment, picker beam channel 32 faces downstream, allowing picker beam flanges 33*a* and 33*b* to slide between stack beam flanges 22*a* and 22*b*. Because picker beam web 34 is located upstream of picker beam flanges 33*a* and 33*b*, hydraulic pressure more firmly seats picker beam flanges 33*a* and 33*b* between stack beam flanges 22*a* and 22*b* and reduces the likelihood of accidental disengagement. In one embodiment, picker beam flanges 22*a* and 22*b* are spaced at a height less than or equal to a height of stack beam web 23. In another embodiment, picker beam flanges 22*a* and 22*b* are spaced at a height greater than a height of stack beam web 23. This configuration allows picker beam flanges 33*a* and 33*b* to surround at least one stack beam 20.

Optional picker beam apertures 35 in picker beam flanges 33*a* and 33*b* allow picker beam 31 to sink through fluids and allow for improved drainage when picker beam 31 rises above the fluid surface. Optional picker beam spacer pads 36 attach to picker beam flanges 33*a* and 33*b*. Picker beam spacer pads 36 can provide increased friction between picker beam flanges 33*a* and 33*b* and stack beam flanges 22*a* and 22*b*, making stack beam 20 less likely to dislodge from picker beam 31. In the exemplary embodiment, picker beam spacer pads 36 are a high-friction material, such as a rubberized material attached to picker beam flanges 33*a* and 33*b* with an adhesive or fastened with mechanical fasteners. In other embodiments, picker beam spacer pads 36 may be texturized regions of picker beam flanges 33*a* and 33*b*.

A proximal end of picker rod 37 connects to picker beam 31 via picker connector 38. Because a downstream side of picker beam 31 engages an upstream side or sides of stack beams 20, picker rod 37 must connect to an upstream side of picker beam 31. Picker rod 37 may connect through picker beam flanges 33*a* and/or 33*b*, or along picker beam web 34. A distal end of picker rod 37 extends above the maximum height of the plurality of stacker beams 20, allowing application of a lifting force to picker mechanism 30. In one embodiment, a mechanical device operatively attached to the distal end of picker rod 37 provides the lifting force when actuated. In another embodiment, the lifting force is manual.

Figure 2:
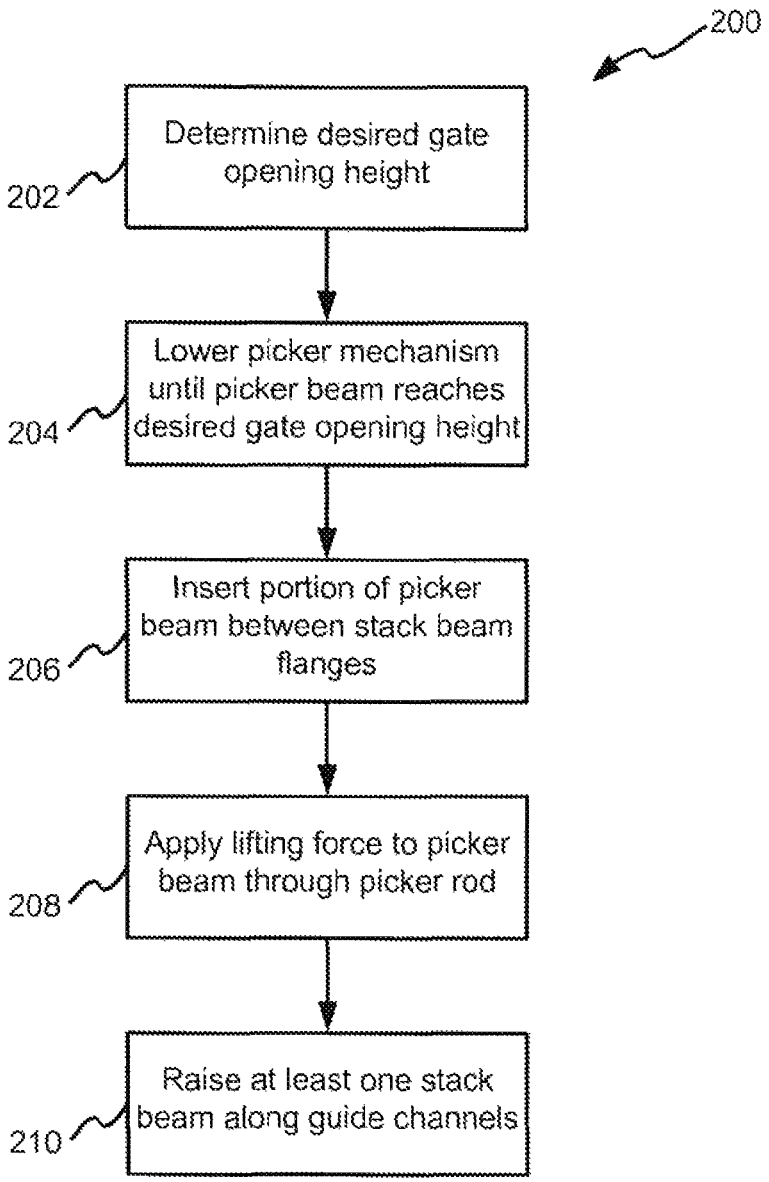
FIG. 2 is a flowchart illustrating an exemplary embodiment of a method for opening an incrementally adjustable fluid control system.

FIG. 2 is a flowchart illustrating an exemplary embodiment of a method 200 for opening an incrementally adjustable fluid control system 100.

In step 202, method 200 determines a desired gate opening height within stack beams 20 constrained by two guide channels 10 in opposition.

In step 204, method 200 lowers picker mechanism 30 until picker beam 31 reaches a stack beam 20 corresponding to the desired gate opening height.

In step 206, method 200 inserts a portion of picker beam 31 between stack beam flanges 22*a* and 22*b* of at least one of the plurality of stack beams 20. In one embodiment, method 200 inserts at least one of picker beam flanges 33*a* and 33*b* between stack beam flanges 22*a* and 22*b*.

In step 208, method 200 applies a lifting force to picker beam 31 through picker rod 37. In one embodiment, application of the lifting force includes actuating a mechanical device providing the lifting force.

In step 210, method 200 raises at least one of the plurality of stack beams 20 along guide channels 10.

Figure 3:
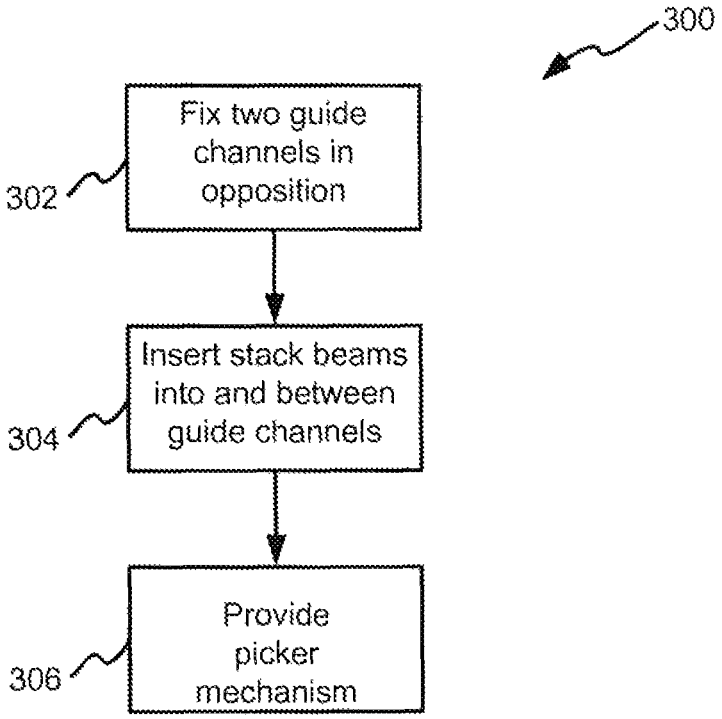
FIG. 3 is a flowchart illustrating an exemplary embodiment of a method for installing an incrementally adjustable fluid control system.

FIG. 3 is a flowchart illustrating an exemplary embodiment of a method 300 for installing an incrementally adjustable fluid control system 100.

In step 302, method 300 fixes two guide channels 10 in opposition. In certain embodiments, guide channels 10 bracket a fluid channel. In other embodiments, multiple guide channels 10 may be attached along their respective guide channel webs 12 to connect multiple incrementally adjustable fluid control systems 100. In still other embodiments, guide channels 10 may be attached along their respective guide channel webs 12 to posts or other structures within a fluid channel or reservoir to enable fluid guidance.

In step 304, method 200 inserts a plurality of stack beams 20 into and between guide channels 10. In such a configuration, the plurality of stack beams 20 are constrained between guide channels 10 and substantially block movement of a fluid through an area located between guide channels 10.

In step 306, method 200 supplies picker mechanism 30.

It will be understood that many additional changes in the details, materials, procedures and arrangement of parts, which have been herein described and illustrated to explain the nature of the invention, may be made by those skilled in the art within the principle and scope of the invention as expressed in the appended claims.

It should be further understood that the drawings are not necessarily to scale; instead, emphasis has been placed upon illustrating the principles of the invention. Moreover, the terms "substantially" or "approximately" as used herein may be applied to modify any quantitative representation that could permissibly vary without resulting in a change in the basic function to which it is related.

What is claimed is:

1. An incrementally adjustable fluid control system comprised of: two guide channels located in opposition, wherein each guide channel is comprised of a plurality of guide channel flanges connected by a guide channel web; a plurality of stack beams constrained between said two guide channels, wherein each stack beam is comprised of a stack beam channel and a plurality of stack beam flanges operatively connected by a stack beam web, wherein each stack beam is comprised of a non-porous, non-buoyant material; and a picker mechanism comprised of a picker beam operatively connected to a picker rod by a picker connector, wherein said picker beam is comprised of a picker beam channel and a plurality of picker beam flanges operatively connected by a picker beam web, and wherein the flanges of the lifting mechanism engage the flanges of one or more of the plurality of stack beams to raise one or more of the plurality of stack beams and adjust the fluid control system.

2. The system of claim 1, wherein said guide channel web has a length approximately 5% to approximately 15% longer than a length of said plurality of stack beam flanges.

3. The system of claim 1, wherein said plurality of guide channel flanges have a width greater than twice a horizontal tolerance of said plurality of stack beams.

4. The system of claim 1, wherein said guide channel web attaches to said side of said fluid channel using means selected from the group consisting of: an adhesive and at least one mechanical faster.

5. The system of claim 1, wherein said plurality of stack beams comprise a material selected from: composite material, stainless steel and marine grade aluminum.

6. The system of claim 1, wherein at least one of said plurality of stack beams is attached to another of said plurality of stack beams.

7. The system of claim 1, wherein said picker beam has a width of approximately 50% to less than 100% of the width of said plurality of stack beams.

8. The system of claim 1, wherein a distal end of said picker rod operatively attaches to a mechanical lifting mechanism.

9. The system of claim 1, wherein a distal end of said picker rod extends above a maximum height of stack beams.

10. The system of claim 1, wherein said picker beam further comprises a plurality of picker beam apertures extending through said plurality of picker beam flanges.

11. The system of claim 1, wherein said picker beam further comprises a plurality of picker beam spacer pads operatively connected to said plurality of picker beam flanges.

12. The system of claim 1, wherein a proximal end of said picker rod extends through at least one of said plurality of picker beam flanges.

13. The system of claim 1, wherein a proximal end of said picker rod extends along said picker beam web.

14. The system of claim 1, wherein said picker beam web is located upstream of said picker beam flanges.

15. The system of claim 1, wherein said picker beam flanges are spaced at a height less than or equal to a height of said stack beam web.

16. The system of claim 1, wherein said picker beam flanges are spaced at a height greater than a height of said stack beam web.

17. A method for opening an incrementally adjustable fluid control system, comprising the steps of: determining a desired gate opening height within a plurality of stack beams constrained between two guide channels, wherein each guide channel is comprised of a plurality of guide channel flanges connected by a guide channel web, wherein each stack beam is comprised of a stack beam channel and a plurality of stack beam flanges operatively connected by a stack beam web, wherein each stack beam is comprised of a non-porous, non-buoyant material; lowering a picker mechanism comprised of a picker beam operatively connected to a picker rod by a picker connector until said picker beam reaches a stack beam corresponding to said desired gate opening height; inserting a portion of said picker beam flanges between at least two of said plurality of stack beam flanges; applying a lifting force to said picker beam through said picker rod; raising at least one of said plurality of stack beams along said two guide channels to form a gate opening at the desired height.

18. The method of claim 17, wherein applying said lifting force to said picker beam through said picker rod comprises actuating a mechanical device providing said lifting force.

* * * * *